US008535094B2

(12) United States Patent
Youn et al.

(10) Patent No.: US 8,535,094 B2
(45) Date of Patent: Sep. 17, 2013

(54) ELASTIC MEMBER AND SHIELDED CONNECTOR ASSEMBLY HAVING THE SAME

(75) Inventors: Bok-Hee Youn, Nam-gu (KR); Yong-Joon Noh, Anyang-si (KR); Sei-Hoon Cho, Ansan-si (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 393 days.

(21) Appl. No.: 12/933,451

(22) PCT Filed: Apr. 1, 2009

(86) PCT No.: PCT/KR2009/001662

§ 371 (c)(1), (2), (4) Date: Oct. 21, 2010

(87) PCT Pub. No.: WO2009/145457

PCT Pub. Date: Dec. 3, 2009

(65) Prior Publication Data

US 2011/0045699 A1 Feb. 24, 2011

(30) Foreign Application Priority Data

Apr. 1, 2008 (KR) ..... 10-2008-0030297
Apr. 1, 2008 (KR) ..... 10-2008-0030298
Apr. 1, 2008 (KR) ..... 10-2008-0030317

(51) Int. Cl.
*H01R 13/648* (2006.01)

(52) U.S. Cl.
USPC ..... 439/607.17; 439/607.19

(58) Field of Classification Search
None
See application file for complete search history.

(56) References Cited

U.S. PATENT DOCUMENTS

| | | | | |
|---|---|---|---|---|
| 4,106,839 | A * | 8/1978 | Cooper | 439/607.18 |
| 4,874,337 | A * | 10/1989 | Paukovits et al. | 439/607.18 |
| 4,975,085 | A * | 12/1990 | Cartesse et al. | 439/607.17 |
| 5,743,760 | A * | 4/1998 | Inaba et al. | 439/489 |
| 5,975,957 | A * | 11/1999 | Noda et al. | 439/607.19 |
| 6,056,578 | A * | 5/2000 | Lin | 439/358 |
| 6,126,496 | A * | 10/2000 | Shinozaki | 439/862 |
| 6,280,227 | B1 | 8/2001 | Terada et al. | |
| 6,827,596 | B2 * | 12/2004 | Hori | 439/188 |
| 2007/0243730 | A1 | 10/2007 | Gladd et al. | |

FOREIGN PATENT DOCUMENTS

| | | |
|---|---|---|
| CN | 1264937 A | 8/2000 |
| JP | 2003-229212 | 8/2003 |
| KR | 10-2000-0071291 | 11/2000 |
| KR | 20-0210506 | 1/2001 |

* cited by examiner

*Primary Examiner* — Michael Zarroli
(74) *Attorney, Agent, or Firm* — Sherr & Jiang, PLLC

(57) ABSTRACT

Disclosure relates to an elastic member mounted in a securing part formed at a male shielded connector or a female shielded connector and configured to establish an electrical connection between the male shielded connector and the female shielded connector when the male shielded connector and the female shielded connector are assembled. The elastic member includes a plate spring having a predetermined length; an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled.

9 Claims, 7 Drawing Sheets

ELASTIC MEMBER AND SHIELDED CONNECTOR ASSEMBLY HAVING THE SAME

CROSS REFERENCE TO PRIOR APPLICATIONS

This application is a National Stage Patent Application of International Patent Application No. PCT/KR2009/001662 (filed on Apr. 1, 2009) under 35 U.S.C. §371, which claims priority to Korean Patent Application Nos. 10-2008-0030297 (filed on Apr. 1, 2008), 10-2008-0030298 (filed on Apr. 1, 2008), and 10-2008-0030317 (filed on Apr. 1, 2008), which are all hereby incorporated by reference in their entirety.

TECHNICAL FIELD

The present invention relates to an elastic member and a shielded connector assembly having the same, and in particular, to an elastic member that is installed outside of a terminal contact portion where a male shielded connector is connected to a female shielded connector, and consequently prevents metal powder generated due to its friction with the male or female shielded connector from intruding into the terminal contact portion, and permits easy connection and detachment of the male shielded connector to/from the female shielded connector and stably maintains the connection between the male shielded connector and the female shielded connector, and a shielded connector assembly having the same.

BACKGROUND ART

Recently, vehicles are automatized by a plurality of electronic components and sensors. The electronic component and sensor are electrically connected to a controller, an operating system or a power source through a cable or a cable connector coupled to the cable, and transmit control signals or power. At this time, an irregular electromagnetic wave is generated by an electrical signal, so that malfunction occurs to the electronic component or the sensor controlled by a fine signal, resulting in a traffic accident.

Generally, signal transmission between the electronic component and the controller is made by a harness for connecting the electronic component to the controller. The harness has a plurality cables, and connectors installed at one end or both ends of the cables. The plural cables are bundled into one bunch by a bundling member. The connector of the harness is connected to a connector directly attached to an electronic equipment unit such as the electronic component, the controller and the operating system.

The cable and connector of the harness and the connector attached to the electronic equipment unit should be protected from external electrical interference so as to prevent distortion of a signal transmitted therethrough. In the case that signal distortion occurs due to indirect/direct electrical interference from an external source, a driver may get into danger due to malfunction of the controller and so on. Therefore, it needs to protect the cable and connector of the harness and the connector attached to the electronic equipment unit from external electrical interference.

A method for protecting the cable of the harness from external electrical interference is largely divided into individual shielding and bunch shielding. The individual shielding method installs a shield member within each cable, and the bunch shielding method forms a woven layer or installs a shield member around the outside of a cable bunch to simultaneously shield external electrical interference.

The connector of the harness or the connector attached to the electronic equipment unit is formed as a shielded connector for shielding external electrical interference. That is, a female shielded connector of the harness is electrically connected to a male shielded connector of the electronic equipment unit to form a shield structure that prevents malfunction caused by an electromagnetic wave. For example, the shield structure is formed by connecting the male shielded connector to the female shielded connector with bolts.

However, the bolt used to connect the male shielded connector to the female shielded connector invites the increased size of products, and makes it difficult to connect and detach the male shielded connector to/from the female shielded connector. And, the bolt and the male and female shielded connectors coupled to the bolt are worn away or the bolt gets loose under various conditions of vehicle jolting where a shielded connector assembly (comprising the male shielded connector and the female shielded connector) is placed. Further, metal powder is generated due to wear and tear of the bolt and the male and female shielded connectors coupled to the bolt, and intrudes into a terminal contact portion between the male shielded connector and the female shielded connector, resulting in short circuit and arc.

Meanwhile, as vehicles are provided with a plurality of electronic equipment units for function improvement, an installation space for a shielded connector assembly is insufficient. For example, conventionally male and female shielded connectors were formed in the shape of a line, and they were linearly arranged and assembled in a shielded connector assembly. For this reason, it was difficult to install the shielded connector assembly in a small or angled space. To overcome the drawback, studies have been made to efficiently install the shielded connector assembly.

DISCLOSURE OF INVENTION

Technical Problem

To solve the above-mentioned problems, the present invention provides an elastic member that is easy to install at a male or female shielded connector, permits easy assembly and disassembly of a shielded connector assembly, has a simple structure and easy manufacture, and can prevent wear and tear of the male and female shielded connectors and its plastic deformation caused by its excessive contact.

And, the present invention provides an elastic member that improves connection reliability between a male shielded connector and a female shielded connector, and is installed outside of a terminal contact portion where the male shielded connector is connected to the female shielded connector, and consequently can prevent metal powder generated due to its friction with the male or female shielded connector from intruding into the terminal contact portion, and a shielded connector assembly having the same.

Further, the present invention provides an elastic member that provides efficient utilization of an installation space for a shielded connector assembly, and a shielded connector assembly having the same.

Technical Solution

In order to achieve the objects of the present invention, the present invention provides an elastic member that is mounted in a securing part formed at a male shielded connector or a female shielded connector and that is configured to establish an electrical connection between the male shielded connector and the female shielded connector when the male shielded connector and the female shielded connector are assembled. The elastic member includes a plate spring having a predetermined length; an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled. When the male shielded connector and the female shielded connector are assembled, the elastic member is elastically biased to come in contact with the male shielded connector and the female shielded connector, thereby electrically connecting the male shielded connector to the female shielded connector.

Preferably, the elastic piece is curved to have one highest point and one lowest point along the lengthwise direction of the plate spring from a bending portion where the plate spring is bent, and a protrusion is formed on the highest point of the elastic piece and protrudes in the direction away from the securing part.

Preferably, a support is provided to maintain a predetermined interval between a lower surface of the highest point of the elastic piece and the plate spring to prevent excessive deformation of the elastic piece.

According to another aspect of the present invention, a shielded connector assembly comprises a male shielded connector for receiving a connection pin therein; a female shielded connector for receiving a connection terminal connected to the connection pin and a portion of a cable electrically coupled to the connection terminal therein, the female shielded connector being connected to the male shielded connector; and an elastic member mounted in the male shielded connector or the female shielded connector, and when the male shielded connector and the female shielded connector are assembled, being elastically biased to come in contact with the male shielded connector and the female shielded connector, thereby electrically connecting the male shielded connector to the female shielded connector, wherein the shielded connector assembly is configured such that, when the male shielded connector and the female shielded connector are assembled, metal powder generated due to contact between the elastic member and the male shielded connector or the female shielded connector is prevented from intruding into a terminal contact portion where the connection terminal is electrically connected to the connection pin.

Preferably, the male shielded connector includes a male inner housing for receiving the connection pin therein; and a male outer housing for surrounding the male inner housing while being spaced a predetermined interval from the male inner housing, and the shielded connector assembly is configured such that the connection pin is received in the male inner housing and the elastic member is installed outside of the male inner housing, so that the metal powder is prevented from intruding into the terminal contact portion.

More preferably, a sealing member is provided between a connection terminal portion and a terminal cover of the female shielded connector, and when the male shielded connector and the female shielded connector are assembled, is contacted with the male inner housing inserted between the connection terminal portion and the terminal cover, so that the metal powder is prevented from intruding into the terminal contact portion, wherein the terminal cover surrounds the connection terminal portion while being spaced a predetermined interval from the connection terminal.

Preferably, the connection pin has a shape of ''¬'', and includes a first connection port electrically connected to the connection terminal and a second connection portion electrically coupled to an electronic equipment unit, and the male shielded connector has a shape corresponding to the connection pin to receive the connection pin therein, and permits easy installation of the shielded connector assembly in an angled space.

Preferably, the female shielded connector includes a female inner housing for receiving the connection terminal and a portion of a cable electrically coupled to the connection terminal therein; and a female outer housing for surrounding the female inner housing while being spaced a predetermined interval from the female inner housing, and a pair of sealing members are provided along an outer periphery of the female inner housing at a predetermined interval therebetween and the elastic member is installed between the pair of sealing members, so that the metal powder is prevented from intruding into the terminal contact portion.

Preferably, the elastic member includes a plate spring having a predetermined length; an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled.

Preferably, the elastic piece is curved to have one highest point and one lowest point along the lengthwise direction of the plate spring from a bending portion where the plate spring is bent, and a support is provided to maintain a predetermined interval between a lower surface of the highest point of the elastic piece and the plate spring to prevent excessive deformation of the elastic piece.

BRIEF DESCRIPTION OF DRAWINGS

These and other features, aspects, and advantages of preferred embodiments of the present invention will be more fully described in the following detailed description, taken accompanying drawings. In the drawings.

BEST MODE FOR CARRYING OUT THE INVENTION

Hereinafter, the preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

A shielded connector assembly according to the present invention is configured such that, when a male shielded connector and a female shielded connector are assembled, metal powder generated due to contact between an elastic member and the male or female shielded connector is prevented from intruding into a terminal contact portion where a connection terminal is electrically connected to a connection pin.

Figure 1:
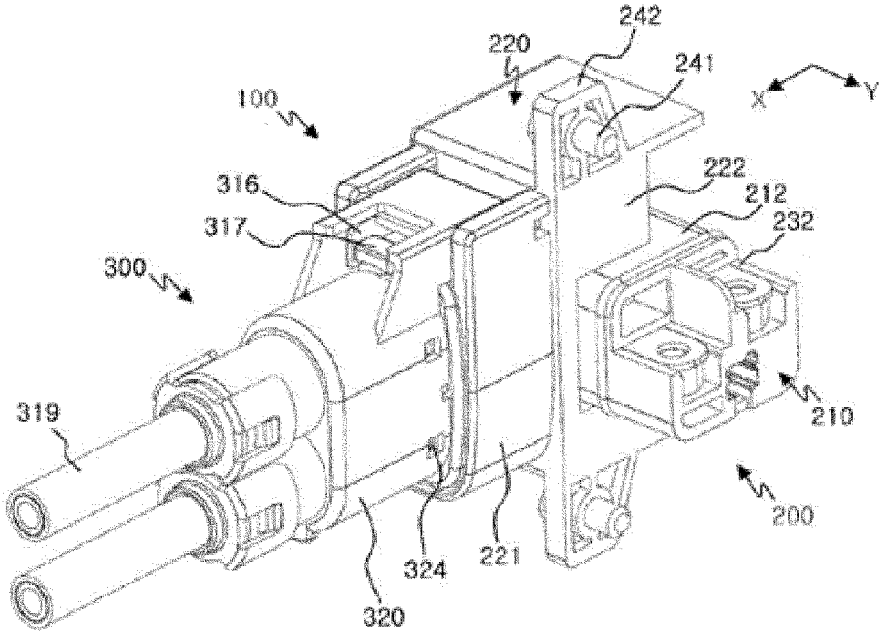
FIG. 1 is a perspective view of a shielded connector assembly according to an embodiment of the present invention.
Figure 2:
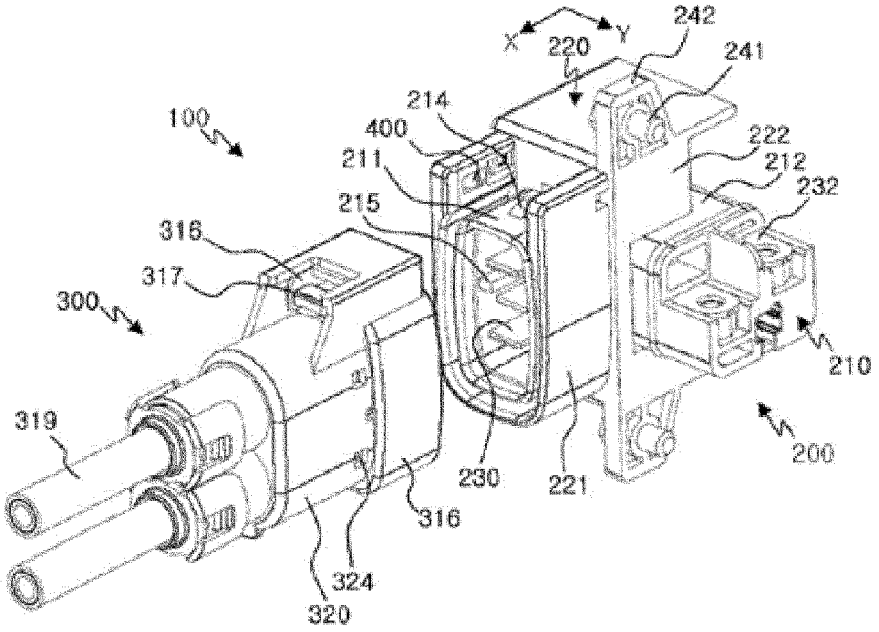
FIG. 2 is an exploded perspective view showing that a male shielded connector and a female shielded connector of the shielded connector assembly of FIG. 1 are disassembled.

FIG. 1 is a perspective view of a shielded connector assembly according to an embodiment of the present invention. FIG. 2 is an exploded perspective view showing that a male shielded connector and a female shielded connector of the shielded connector assembly of FIG. 1 are disassembled.

Referring to FIGS. 1 and 2, the shielded connector assembly 100 according to the present invention includes a male shielded connector 200 installed in an electronic equipment unit (not shown), a female shielded connector 300 connected to the male shielded connector 200, and an elastic member 400 installed at the male shielded connector 200 or the female shielded connector 300 to establish an electrical connection between the male shielded connector 200 and the female shielded connector 300. Here, description is made on the basis that the elastic member 400 is installed at the male shielded connector 200.

The male shielded connector 200 includes a male inner housing 210 receiving a connection pin 230 therein, and a male outer housing 220 connected to the male inner housing 210 and having a securing part 225. The connection pin 230 is connected to a connection terminal 318 received in the female shielded connector 300.

Figure 4:
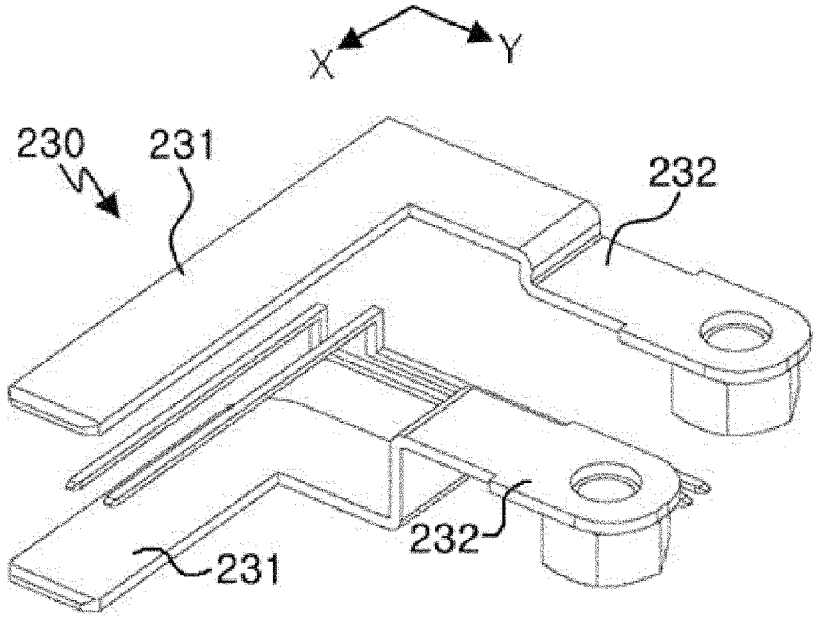
FIG. 4 is a perspective view of a connection pin of the male shielded connector of FIG. 3.

At this time, as shown in FIG. 4, the connection pin 230 includes a first connection portion 231 electrically connected to the connection terminal (318 of FIG. 5), and a second connection portion 232 electrically coupled to the electronic equipment unit (not shown). The connection pin 230 is formed in the shape of ''¬''. The male shielded connector 200 receiving a plurality of connection pins 230 is not formed in the shape of a line, but in the shape of ''¬'', which results in improved efficiency of an installation space.

Figure 5:
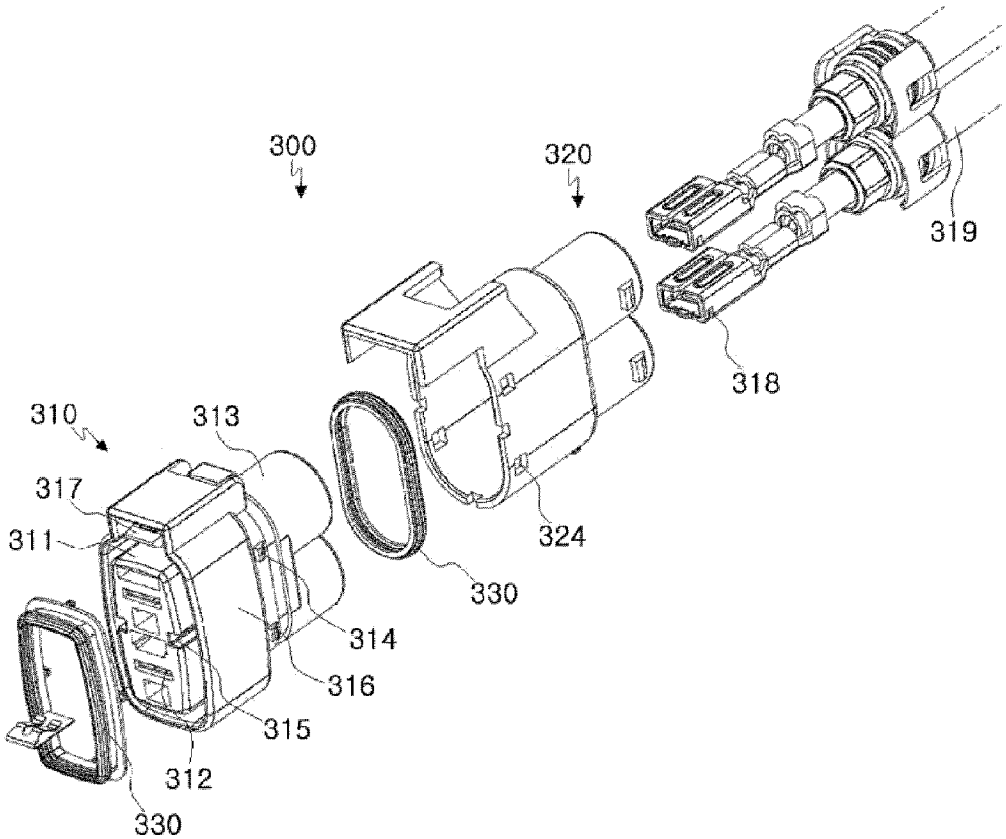
FIG. 5 is an exploded perspective view of the female shielded connector of FIG. 2.
Figure 6:
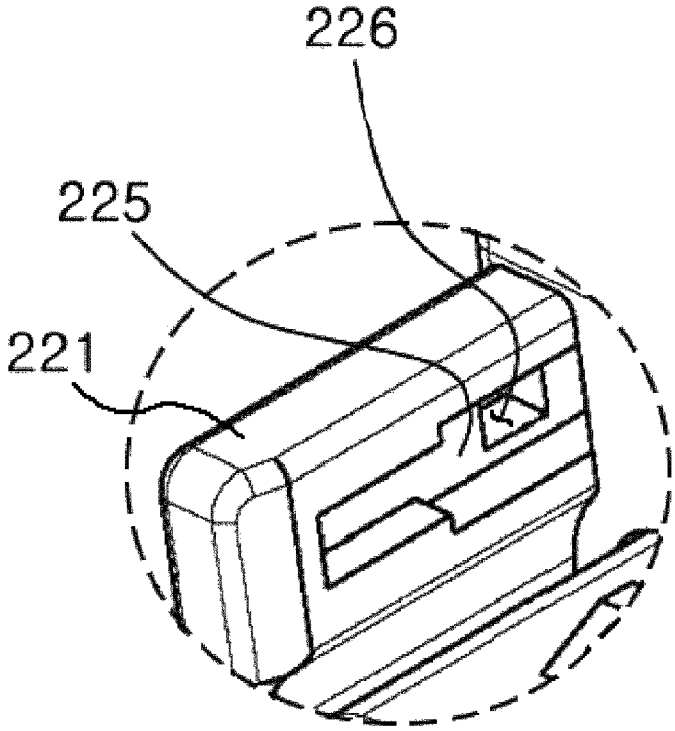
FIG. 6 is a partially enlarged view of a securing part of FIG. 3.

The first connection portion 231 of the connection pin 230 is inserted into a slot 312 of a connection terminal portion 311 of the female shielded connector 300 shown in FIG. 5 and is electrically connected to the connection terminal 318. The second connection portion 232 of the connection pin 230 is electrically coupled to the electronic equipment unit (not shown).

Figure 3:
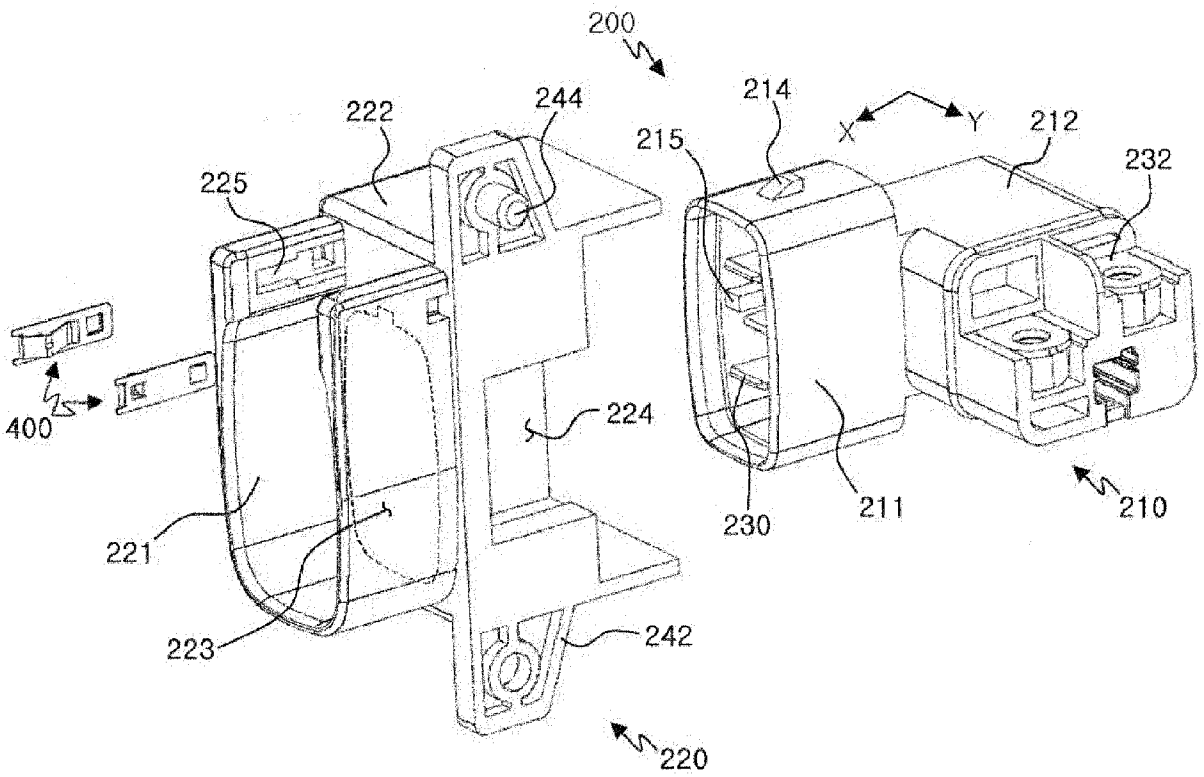
FIG. 3 is an exploded perspective view of the male shielded connector of FIG. 2.

The male inner housing 210 is made of an electrical insulator. More specifically, as shown in FIG. 3, the male inner housing 210 includes a first housing 211 configured to receive the first connection portion 231 of the connection pin 230 therein, and a second housing 212 extending from the first housing 211 to receive the second connection portion 232 of the connection pin 230 therein.

The first housing 211 and the second housing 212 of the male inner housing 210 are configured to receive the connection pin 230 therein, and is formed in the shape of ''¬'', as a whole. At this time, take an assumption that the formation direction of the first connection portion 231 is an X-axis, and the formation direction of the second connection portion 232 is a Y-axis, relative to the first connection portion 231 and the second connection portion 232.

Meanwhile, a connection protrusion 214 is formed at the top of the first housing 211. The connection protrusion 214 is engaged with a locking member 317 of the female shielded connector 300 to be described later, so that a close connection is established between the male shielded connector 200 and the female shielded connector 300 and cannot be easily released from external shocks. Engagement of the connection protrusion 214 with the locking member 317 is described below.

A guide rod 215 may be further provided on the inner surface of the first housing 211 in the direction of X-axis. The guide rod 215 serves as a guide for a stable connection between the connection pin 230 and the connection terminal 318. Accordingly, a guide groove 315, into which the guide rod 215 is inserted, is formed at a location corresponding to the guide rod 215 on the connection terminal 318 connected to the connection pin 230.

The male outer housing 220 is made of a conductive material, and as shown in FIG. 3, includes a first receiving portion 221 having an insertion hole 223, through which the first housing 211 is inserted, and a second receiving portion 222 extending from the first receiving portion 221 to partially receive the second housing 212.

The first receiving portion 221 has an open top, and when the first housing 211 is inserted through the insertion hole 223, the first receiving portion 221 surrounds a lower surface and opposite side surfaces of the first housing 211. At this time, the first receiving portion 221 is spaced a predetermined interval from the first housing 211.

The second receiving portion 222 has a receiving groove 224 for partially receiving the second housing 212. The receiving groove 224 is preferably formed at a side of the insertion direction of the second housing 212. That is, as the first housing 211 is inserted into the first receiving portion 221, the second housing 212 is inserted into the receiving groove 224 of the second receiving portion 222 and is supported by the receiving groove 224. Thus, after the male inner housing 210 is completely installed in the male outer housing 220, the male inner housing 210 is prevented from moving in the directions of X-axis and Y-axis.

Meanwhile, the securing part 225 is formed on the first receiving portion 221 of the male outer housing 220. More specifically, the securing part 225, into which the elastic member 400 is inserted, is formed at the upper and inner side of the first receiving portion 221. The securing part 225 has a fixing hole 226 for fixing the elastic member 400. The securing part 225 is described below in detail.

The reference numeral 242 is a coupling unit for coupling the male outer housing 220 to the electronic equipment unit (not shown) using a bolt 241.

Meanwhile, metal powder generated due to wear and tear of the elastic member 400 is prevented from intruding into the terminal contact portion between the connection terminal (318 of FIG. 5) and the connection pin 230 by receiving the connection pin 230 in the male inner housing 210 and installing the elastic member 400 outside of the male inner housing 210. That is, as the male inner housing 210 is located between the elastic member 400 and the connection pin 230, metal powder is prevented from intruding into the connection pin 230. As a result, the terminal contact portion avoids short circuit and arc, and connection between the male shielded connector 200 and the female shielded connector 300 can be stably maintained.

FIG. 5 is an exploded perspective view of the female shielded connector.

Referring to FIGS. 1, 2 and 5, the female shielded connector 300 includes a female inner housing 310 for receiving the connection terminal 318 and a portion of a cable 319 therein, and a female outer housing 320 connected to the female inner housing 310 and made of a conductive material.

The female inner housing 310 includes the connection terminal portion 311 for receiving the connection terminal 318 and a portion of the cable 319 electrically connected to the connection terminal 318, and a terminal cover 316 surrounding the connection terminal portion 311 while being spaced a predetermined interval from the connection terminal portion 311.

The connection terminal portion 311 has, at one side, the slot 312, into which the connection pin 230 is inserted, and at the other side, an insertion portion 313, into which a portion of the cable 319 is inserted. The insertion portion 313 has a protrusion 314 to be inserted into an insertion groove 324 of the female outer housing 320. That is, the insertion portion 313 is inserted into and connected to the female outer housing 320. As described above, the connection terminal portion 311 has the guide groove 315, into which the guide rod 215 is inserted.

Meanwhile, each sealing member 330 is provided between an outer periphery of the insertion portion 313 and the connection terminal portion 311 and between the outer periphery of the insertion portion 313 and the terminal cover 316, so that the female inner housing 310 is closely connected to the female outer housing 320 to prevent moisture or impurities from intruding into the terminal contact portion between the connection pin 230 and the connection terminal portion 311.

The terminal cover 316 is configured to protect the connection terminal portion 311, and has the locking member 317 at the upper and inner side thereof. The locking member 317 is engaged with the connection protrusion 214 of the first housing 211 to prevent an unintentional release of connection between the male shielded connector 200 and the female shielded connector 300. The locking member 317 may have any structure if it can be engaged with the connection protrusion 214. For example, the locking member 317 may be located at the upper and inner side of the terminal cover 316, make a see-saw movement and has a wedge, with which the connection protrusion 214 is engaged. Alternatively, the locking member 317 may include an elastic deformative plate, and a hole formed on the elastic deformative plate and which the protrusion 214 is inserted into.

The female outer housing 320 has the insertion groove 324, into which the protrusion 314 of the insertion portion 313 is inserted, and surrounds an upper surface of the terminal cover 316. At this time, because the female outer housing 320 surrounds only the upper surface of the terminal cover 316, a lower surface and opposite side surfaces of the terminal cover 316 are exposed to the external environment. The female outer housing 320 is made of a conductive material, and contacts the elastic member 400 when the male shielded connector 200 and the female shielded connector 300 are assembled.

Figure 7:
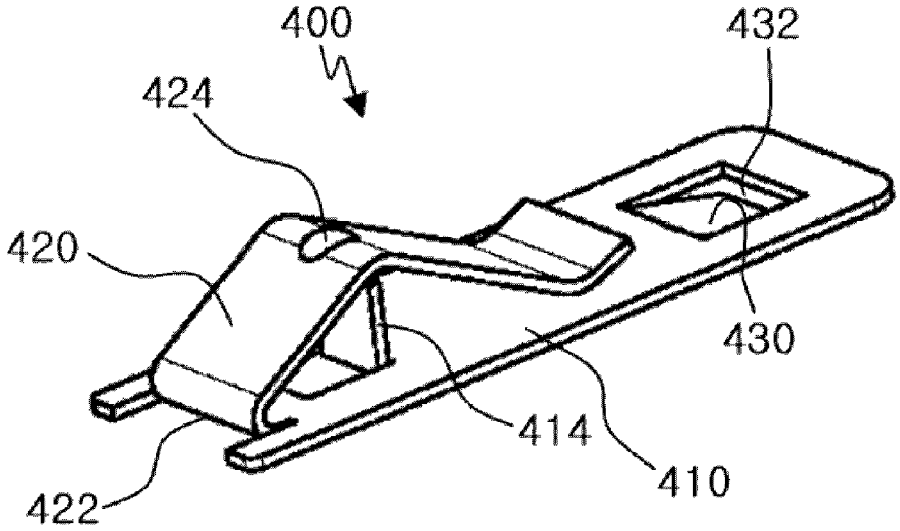
FIG. 7 is a perspective view of an elastic member according to an embodiment of the present invention.

The elastic member 400 of the above-mentioned configuration for electrically connecting the male shielded connector 200 to the female shielded connector 300 is shown in FIG. 7.

Referring to FIGS. 2, 3, 6 and 7, the elastic member 400 includes a plate spring 410 having a predetermined length, an elastic piece 420 formed by bending a portion of one side of the plate spring 410, and a fixing member formed on the plate spring 410 for preventing the elastic member 400 from separating from the male shielded connector 200 when the male shielded connector 200 and the female shielded connector 300 are disassembled.

The plate spring 410 is inserted into the securing part 225, and preferably has a shape corresponding to the securing part 225

The elastic piece 420 is formed by bending a portion of one side of the plate spring 410, and is elastically deformable. More specifically, the elastic piece 420 is curved to have one highest point and one lowest point along the lengthwise direction of the plate spring 410 from a bending portion 422 where the plate spring 410 is bent. At this time, a protrusion 424 is formed on the highest point of the elastic piece 420 and protrudes in the direction away from the securing part 225. If the elastic member 400 is used for a long time, elastic restitution of the elastic piece 420 may reduce, and in this case, a stable contact between the elastic piece 420 and the female shielded connector 300 may not be guaranteed. The protrusion 424 prevents the elastic piece 420 from losing its elastic restitution due to a long-time use of the elastic member 400, thereby ensuring a stable contact between the elastic piece 420 and the female outer housing 320.

Further, a support 414 is preferably provided on the plate spring 410 to prevent an excessive deformation of the elastic piece 420. The support 414 is configured to maintain a predetermined interval between a lower surface of the highest point of the elastic piece 420 and the plate spring 410. When the elastic piece 420 is contacted with the female outer housing 320, the support 414 supports the elastic piece 420 to prevent the elastic piece 420 from being pressed down beyond a predetermined range.

The fixing member is configured to fix the elastic member 400 in the securing part 225, and may have a shape corresponding to the securing part 225.

For example, in the case that a fixing hole 226 is formed on the securing part 225, the fixing member is a fixing portion 430 inserted into the fixing hole 226. More specifically, the fixing portion 430 extends from one side of a hole 432 formed on the plate spring 410. The fixing portion 430 is formed at a predetermined angle, and is elastically deformed to be inserted into the fixing hole 226 of the securing part 225.

Meanwhile, although this embodiment shows that the elastic member 400 is installed at the male shielded connector 200, the present invention is not limited in this regard. The elastic member 400 may be installed at the female outer housing 320 of the female shielded connector 300 and contacted with the male outer housing 220 of the male shielded connector 200.

The elastic member 400 of the above-mentioned configuration is mounted in the securing part 225 such that the plate spring 410 is inserted into the securing part 225, and then the male shielded connector 200 is electrically connected to the female shielded connector 300. And, insertion of the fixing portion 430 into the fixing hole 226 prevents the elastic member 400 from separating from the male shielded connector 200 when the male shielded connector 200 and the female shielded connector 300 are disassembled. The elastic member 400 is easy to install, permits easy assembly and disassembly of the male shielded connector 200 and the female shielded connector 300, and improves connection reliability between the male shielded connector 200 and the female shielded connector 300, compared with a bolt used to mechanically and electrically connect a male shielded connector to a female shielded connector in the art.

The shielded connector assembly 100 is completed by inserting the connection pin 230 into the slot 312 of the connection terminal portion 311 and engaging the connection protrusion 214 with the locking member 317. More specifically, the male shielded connector 200 having the elastic member 400 is installed in the electronic equipment unit (not shown), and the female shielded connector 300 coupled to a harness is connected to the male shielded connector 200. When the male shielded connector 200 and the female shielded connector 300 are assembled, the connection pin 230 received in the male shielded connector 200 is inserted into the slot 312 of the connection terminal portion 311 of the female inner housing 310, and at the same time, the connection terminal portion 311 is inserted into the first housing 211 of the male shielded connector 200. And, the female outer housing 320 and the terminal cover 316 are inserted between the first housing 211 and the first receiving portion 221 of the male shielded connector 200. At this time, the connection protrusion 214 formed at the top of the first housing 211 is engaged with the locking member 317 formed at the upper side of the terminal cover 316. Accordingly, the elastic member 400 installed in the first receiving portion 221 of the male outer housing 220 is contacted with the female outer housing 320 of the female shielded connector 300, so that the male shielded connector 200 is electrically connected to the female shielded connector 300.

Meanwhile, the male shielded connector 200 has a shape of ''¬'', and thus is easy to install in a small or angled space.

Figure 8:
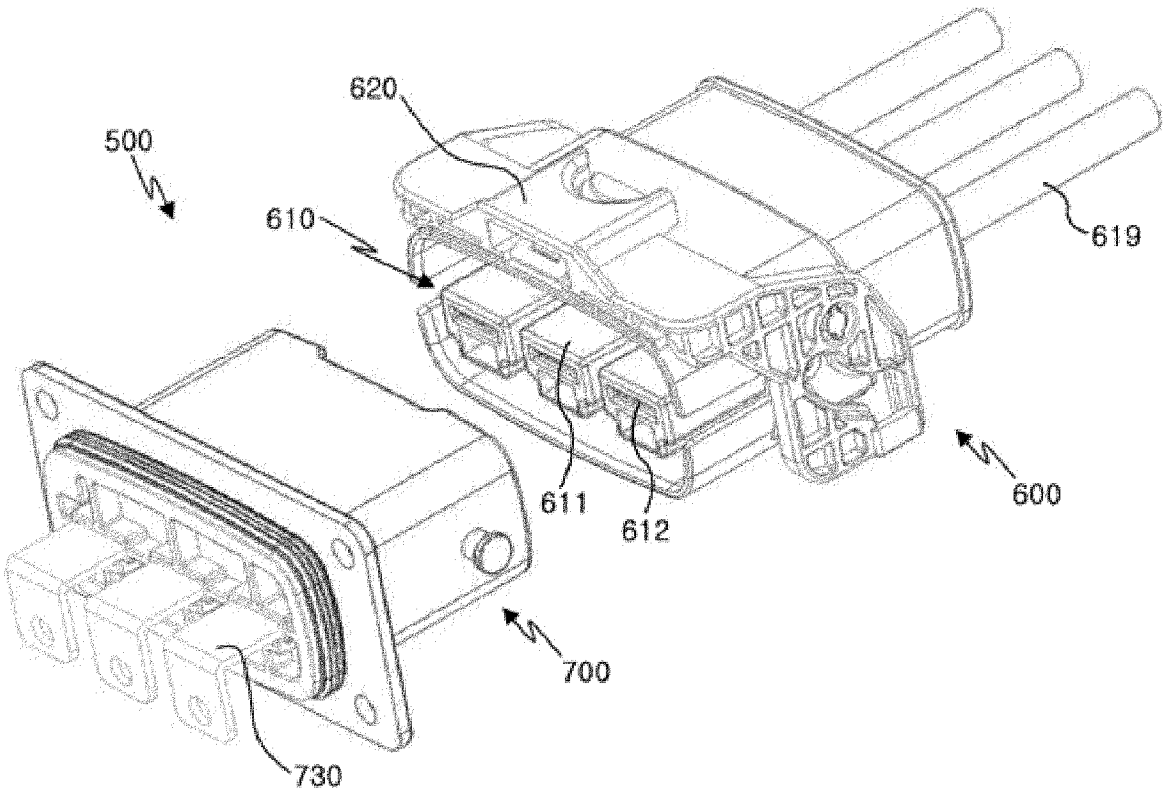
FIG. 8 is an exploded perspective view of a shielded connector assembly according to another embodiment of the present invention.
Figure 9:
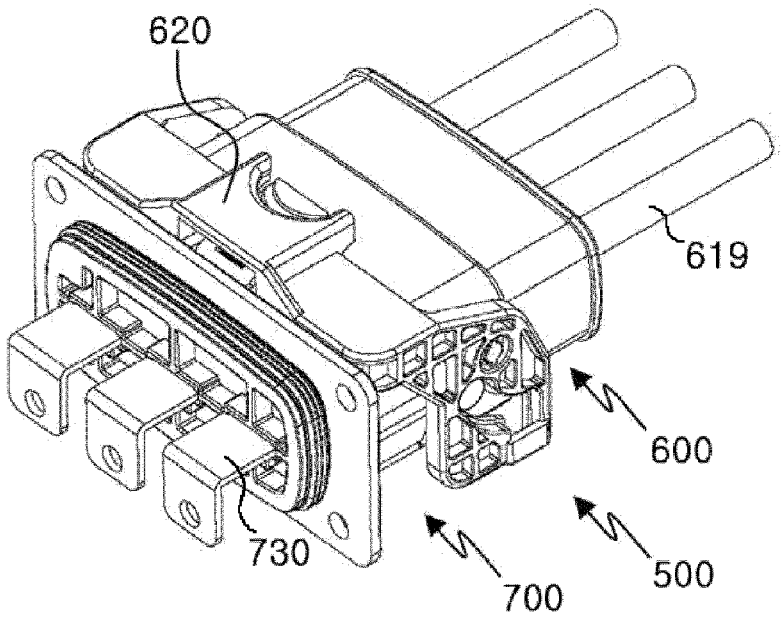
FIG. 9 is an assembled perspective view of FIG. 8.
Figure 10:
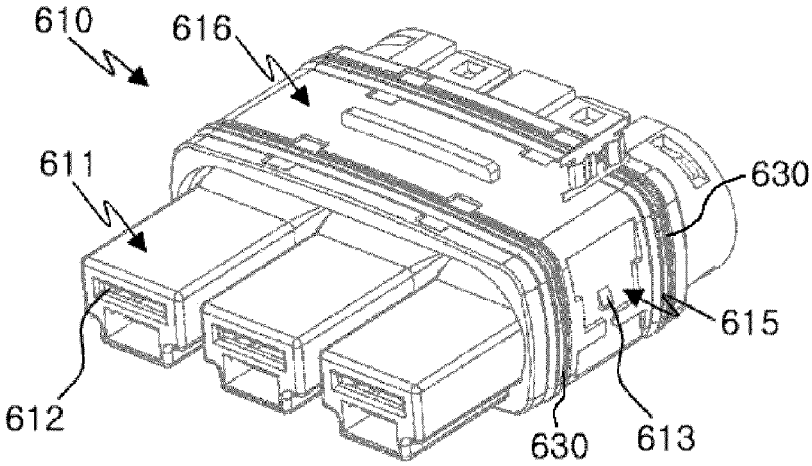
FIG. 10 is a perspective view of a female inner housing of a female shielded connector of FIG. 8.

FIG. 8 is an exploded perspective view of a shielded connector assembly according to another embodiment of the present invention. FIG. 9 is an assembled perspective view of FIG. 8. FIG. 10 is a perspective view of a female inner housing of a female shielded connector of FIG. 8.

Referring to FIGS. 8 to 10, the shielded connector assembly 500 according to the present invention includes a female shielded connector 600 for receiving a connection terminal (not shown) and a portion of a cable 619 electrically coupled to the connection terminal, a male shielded connector 700 for receiving a connection pin 730 connected to the connection terminal therein, installed in an electronic equipment unit (not shown) and connected to the female shielded connector 600, and an elastic member 800 installed at the male shielded connector 700 or the female shielded connector 600 for electrically connecting the male shielded connector 700 to the female shielded connector 600. Here, description is made on the basis that the elastic member 800 is installed at the female shielded connector 600.

The female shielded connector 600 includes a female inner housing 610, and a female outer housing 620 connected to the female inner housing 610 and surrounding the female inner housing 610 while being spaced a predetermined interval from the female inner housing 610.

The female inner housing 610 includes a connection terminal portion 611 for receiving the connection terminal (not shown) and a portion of the cable 619 electrically coupled to the connection terminal, and a metal housing 616 connected to the connection terminal portion 611 and having a securing part 615.

The connection terminal portion 611 has a slot 612, into which the connection pin 730 of the male shielded connector 700 is inserted, and is made of an electrical insulator.

The metal housing 616 is configured to receive a portion of the connection terminal portion 611, and is connected to the connection terminal portion 611. At this time, each securing part 615, in which the elastic member 800 is installed, is formed at both sides of the metal housing 616. The metal housing 616 is made of a conductive material, and thus is electrically connected to the male shielded connector 700 by the elastic member 800 when the male shielded connector 700 and the female shielded connector 600 are assembled.

Meanwhile, a sealing member 630 is provided along an outer periphery of the metal housing 616. Preferably, each sealing member 630 is installed at the front and rear of the metal housing 616 having the securing part 615. That is, the sealing members 630 are located at both sides of the securing part 615. The sealing member 630 prevents moisture or impurities from intruding into a terminal contact portion where the connection pin 730 is electrically connected to the connection terminal (not shown).

The securing part 615, into which the elastic member 800 is inserted, has a fixing protrusion 613 for fixing the elastic member 800. The securing part 615 is described in detail below.

Meanwhile, metal powder generated due to wear and tear of the elastic member 800 is prevented from intruding into the terminal contact portion between the connection terminal and the connection pin 730 by providing the pair of sealing members 630 along the outer periphery of the female inner housing 610 at a predetermined interval therebetween and installing the elastic member 800 between the pair of sealing members 630. That is, the pair of sealing members 630 are, respectively, located in front and rear of the elastic members 800 installed at both sides of the metal housing 616, and prevent metal powder from intruding into the terminal contact portion. Accordingly, the terminal contact portion avoids short circuit and arc, and a connection between the male shielded connector 700 and the female shielded connector 800 can be stably maintained.

The female outer housing 620 surrounds the female inner housing 610, is made of a conductive material, and thus serves as an electromagnetic shield. Preferably, the entire of the female outer housing 620 is made of a conductive material. However, only an inner surface of the female outer housing 620 may be made of a conductive material.

Hereinafter, the elastic member 800 and installation of the elastic member 800 in the securing groove 615 is described with reference to FIGS. 11 to 13.

Figure 11:
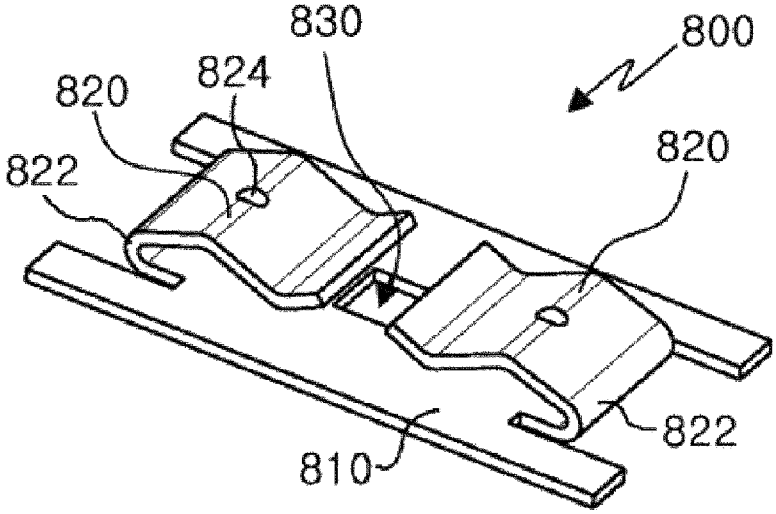
FIG. 11 is a perspective view of an elastic member according to another embodiment of the present invention.
Figure 12:
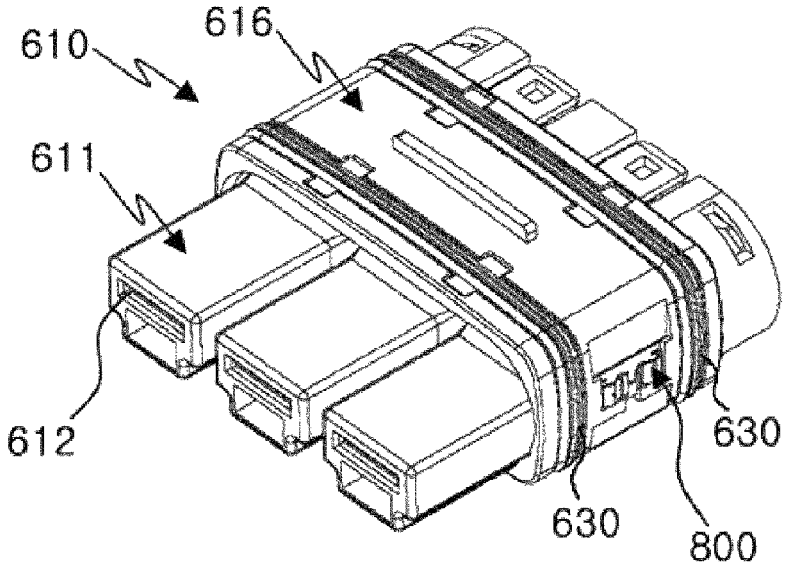
FIG. 12 is a perspective view showing that an elastic member is installed at the female inner housing of the female shielded connector of FIG. 8.
Figure 13:
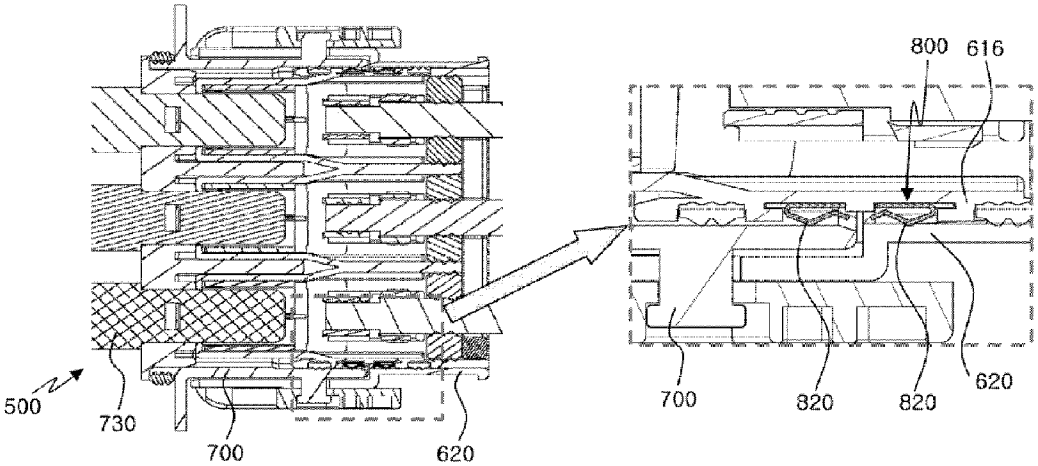
FIG. 13 is a cross-sectional view of FIG. 9.

Referring to FIGS. 11 to 13, the elastic member 800 includes a plate spring 810 having a predetermined length, an elastic piece 820 formed by bending a portion of the opposite sides of the plate spring 810, and a fixing member formed on the plate spring 810 for fixing the elastic member 800.

The plate spring 810 is inserted into the securing part 615, and preferably has a shape corresponding to the securing part 615.

The elastic piece 820 is formed by bending a portion of the opposite sides of the plate spring 810 toward the center of the plate spring 810, and is elastically deformable. More specifically, each elastic piece 820 is curved to have one highest point and one lowest point along the lengthwise direction of the plate spring 810 from a bending portion 822 where the plate spring 810 is bent. At this time, a protrusion 824 is formed on the highest point of the elastic piece 820 and protrudes in the direction away from the securing part 615. If the elastic member 800 is used for a long time, elastic restitution of the elastic piece 820 may reduce, and in this case, a stable contact between the elastic piece 820 and the male shielded connector 700 may not be guaranteed. The protrusion 824 prevents the elastic piece 820 from losing its elastic restitution due to a long-time use of the elastic member 800, thereby ensuring a stable contact between the elastic piece 820 and the male shielded connector 700.

Further, a support (not shown) may be provided on the plate spring 810 to prevent an excessive deformation of the elastic piece 820. The support is configured to maintain a predetermined interval between a lower surface of the highest point of the elastic piece 820 and the plate spring 810. When the elastic piece 820 is contacted with the male shielded connector 700, the support supports the elastic piece 820 to prevent the elastic piece 820 from being pressed down beyond a predetermined range.

The fixing member is configured to fix the elastic member 800 in the securing part 615, and may have a shape corresponding to the securing part 615.

For example, in the case that a fixing protrusion 613 is formed on the securing part 615, the fixing member is a fixing groove 830, into which the fixing protrusion 613 is inserted. More specifically, the fixing groove 830 is located at the center of the plate spring 810. The fixing groove 830 has a shape corresponding to the fixing protrusion 613 to receive the fixing protrusion 613 therein.

Meanwhile, although the above-mentioned embodiment shows that the elastic member 800 is installed at the metal housing 616 of the female shielded connector 600, the present invention is not limited in this regard. The elastic member 800 may be installed at an inner side of the male shielded connector 700 and contacted with the metal housing 616 of the female shielded connector 600.

When the elastic member 800 of the above-mentioned configuration is mounted in the securing part 615, the plate spring 810 is inserted into the securing part 615, and then the male shielded connector 700 is electrically connected to the female shielded connector 600. At this time, the fixing protrusion 613 is inserted into the fixing groove 630, so that the elastic member 800 is prevented from separating from the female shielded connector 600 when the male shielded connector 700 and the female shielded connector 600 are disassembled.

The shielded connector assembly 500 of the above-mentioned configuration is completed by inserting the connection pin 730 into the slot 612 of the connection terminal portion 611. More specifically, the male shielded connector 700 is inserted between the female inner housing 610 and the female outer housing 620 of the female shielded connector 600, and then the male shielded connector 700 is electrically connected to the female shielded connector 600. At this time, the inner surface of the male shielded connector 700 is contacted with the elastic member 800. Accordingly, an electrical connection is established between the male shielded connector 700 and the female shielded connector 600 by the elastic member 800.

As such, a stable electrical connection of the shielded connector assemblies 100 and 500 is achieved by the elastic member 400 and 800, respectively. At this time, if the male shielded connectors 200 and 700 and the female shielded connectors 300 and 600 are repetitively assembled and disassembled, a contact surface with the elastic members 400 and 800 wears away, results in generation of metal powder. However, according to the shielded connector assemblies 100 and 500 of the present invention, the elastic members 400 and 800 are installed outside of terminal contact portions where the connection pins 230 and 730 are electrically connected to the connection terminals, respectively. Therefore, the present invention can prevent metal powder from intruding into the terminal contact portions, ensure a stable connection between the male shielded connectors 200 and 700 and the female shielded connectors 300 and 600, and improve the life of products. Further, the present invention includes the sealing members 330 and 630 adjacent to the terminal contact portions, that prevent metal powers and moisture or external impurities from intruding into the terminal contacts portions.

Described above are the preferred embodiments of the present invention. However, it should be understood that the detailed description and specific examples, while indicating preferred embodiments of the invention, are given by way of illustration only, since various changes and modifications within the spirit and scope of the invention will become apparent to those skilled in the art from this detailed description.

Industrial Applicability

As mentioned above, an elastic member to the present invention and a shielded connector assembly having the same have the following effects.

First, the elastic member is installed outside of a terminal contact portion where a male shielded connector is electrically connected to a female shielded connector. Thus, it prevents metal powder generated due to friction between the elastic member and the male or female shielded connector from intruding into the terminal contact portion, thereby stably maintaining the connection between the male shielded connector and the female shielded connector.

Secondly, it permits easy assembly and disassembly of the male shielded connector and the female shielded connector, and enables a firm connection between the male and female shielded connectors.

Thirdly, it provides efficient utilization of an installation space for a shielded connector assembly.

Fourthly, the elastic member has a simple structure and easy manufacture. Thus, it is easy to mount and separate the elastic member at/from the male or female shielded connector.

Fifthly, it can prevent wear and tear of the elastic member and the male and female shielded connectors caused by excessive vibration and contact. Thus, it ensures a long-term durability of the elastic member and the male and female shielded connectors.

Sixthly, it prevents plastic deformation of the elastic member, thereby stably maintaining a connection between the male shielded connector and the female shielded connector.

Seventhly, it prevents permeation of moisture from the external environment into a terminal contact portion between a connection pin and a connection terminal.

The invention claimed is:

1. An elastic member mounted in a securing part formed at a male shielded connector or a female shielded connector and configured to establish an electrical connection between the male shielded connector and the female shielded connector when the male shielded connector and the female shielded connector are assembled, the elastic member comprising:

a plate spring having a predetermined length;

an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled, wherein, when the male shielded connector and the female shielded connector are assembled, the elastic member is elastically biased to come in contact with the male shielded connector and the female shielded connector, thereby electrically connecting the male shielded connector to the female shielded connector, wherein the elastic piece is curved to have one highest point and one lowest point along the lengthwise direction of the plate spring from a bending portion where the plate spring is bent, wherein the highest point of the elastic piece is elastically deformable when the elastic member is contacted with the male shielded connector or the female shielded connector, and wherein a protrusion is formed on the highest point of the elastic piece and protrudes in the direction away from the securing part to ensure a stable contact between the elastic member and the male shielded connector or the female shielded connector.

2. The elastic member according to claim 1, wherein a support is provided to maintain a predetermined interval between a lower surface of the highest point of the elastic piece and the plate spring to prevent excessive deformation of the elastic piece.

3. A shielded connector assembly, comprising:

a male shielded connector for receiving a connection pin therein;

a female shielded connector for receiving a connection terminal connected to the connection pin and a portion of a cable electrically coupled to the connection terminal therein, the female shielded connector being connected to the male shielded connector; and an elastic member mounted in the male shielded connector or the female shielded connector, and when the male shielded connector and the female shielded connector are assembled, being elastically biased to come in contact with the male shielded connector and the female shielded connector, thereby electrically connecting the male shielded connector to the female shielded connector, wherein the shielded connector assembly is configured such that, when the male shielded connector and the female shielded connector are assembled, metal powder generated due to contact between the elastic member and the male shielded connector or the female shielded connector is prevented from intruding into a terminal contact portion where the connection terminal is electrically connected to the connection pin, wherein the male shielded connector includes:

a male inner housing for receiving the connection pin therein; and a male outer housing for partially surrounding the male inner housing while being spaced a predetermined interval from the male inner housing, and wherein the shielded connector assembly is configured such that the connection pin is received in the male inner housing and the elastic member is installed outside of the male inner housing, so that the metal powder is prevented from intruding into the terminal contact portion, wherein a sealing member is provided between a connection terminal portion and a terminal cover of the female shielded connector, the terminal cover surrounding the connection terminal portion while being spaced a predetermined interval from the connection terminal, the sealing member being contacted with the male inner housing inserted between the connection terminal portion and the terminal cover when the male shielded connector and the female shielded connector are assembled, so that the metal powder is prevented from intruding into the terminal contact portion.

4. The shielded connector assembly according to claim 3, wherein the connection pin has a shape of 'ㄱ', and includes a first connection portion electrically connected to the connection terminal and a second connection portion electrically coupled to an electronic equipment unit, and wherein the male shielded connector has a shape corresponding to the connection pin to receive the connection pin therein, and permits easy installation of the shielded connector assembly in an angled space.

5. The shielded connector assembly according to claim 3, wherein the elastic member includes:

a plate spring having a predetermined length;

an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled.

6. The shielded connector assembly according to claim 5, wherein the elastic piece is curved to have one highest point and one lowest point along the lengthwise direction of the plate spring from a bending portion where the plate spring is bent, and wherein a support is provided to maintain a predetermined interval between a lower surface of the highest point of the elastic piece and the plate spring to prevent excessive deformation of the elastic piece.

7. A shielded connector assembly, comprising:

a male shielded connector for receiving a connection pin therein;

a female shielded connector for receiving a connection terminal connected to the connection pin and a portion of a cable electrically coupled to the connection terminal therein, the female shielded connector being connected to the male shielded connector; and an elastic member mounted in the male shielded connector or the female shielded connector, and when the male shielded connector and the female shielded connector are assembled, being elastically biased to come in contact with the male shielded connector and the female shielded connector, thereby electrically connecting the male shielded connector to the female shielded connector, wherein the shielded connector assembly is configured such that, when the male shielded connector and the female shielded connector are assembled, metal powder generated due to contact between the elastic member and the male shielded connector or the female shielded connector is prevented from intruding into a terminal contact portion where the connection terminal is electrically connected to the connection pin, wherein the female shielded connector includes:

a female inner housing for receiving the connection terminal and the portion of the cable electrically coupled to the connection terminal therein; and a female outer housing for surrounding the female inner housing while being spaced a predetermined interval from the female inner housing, and wherein a pair of sealing members are provided along an outer periphery of the female inner housing at a predetermined interval therebetween and the elastic member is installed between the pair of sealing members, so that the metal powder is prevented from intruding into the terminal contact portion.

8. The shielded connector assembly according to claim 7, wherein the elastic member includes:

a plate spring having a predetermined length;

an elastic piece being elastically deformable and formed by bending a portion of one or both sides of the plate spring in the lengthwise direction of the plate spring; and a fixing member formed on the plate spring and configured to prevent the elastic member from separating from the male shielded connector or the female shielded connector when the male shielded connector and the female shielded connector are disassembled.

9. The shielded connector assembly according to claim 8, wherein the elastic piece is curved to have one highest point and one lowest point along the lengthwise direction of the plate spring from a bending portion where the plate spring is bent, and wherein a support is provided to maintain a predetermined interval between a lower surface of the highest point of the elastic piece and the plate spring to prevent excessive deformation of the elastic piece.

* * * * *